United States Patent [19]

Gammell et al.

[11] 4,199,074

[45] Apr. 22, 1980

[54] ENCLOSED SEAL FOR OPEN TOP VOLATILE LIQUID STORAGE TANKS

[75] Inventors: Donald M. Gammell, 315 N. Old Ranch Rd., Arcadia, Calif. 91006; Homer J. Foye, Arcadia, Calif.

[73] Assignee: Donald M. Gammell, Arcadia, Calif.; a part interest

[21] Appl. No.: 942,346

[22] Filed: Sep. 14, 1978

[51] Int. Cl.[2] ..... B65D 25/00; B65D 87/20

[52] U.S. Cl. ..... 220/218; 220/221; 220/227; 220/85 A; 220/85 VS

[58] Field of Search ..... 220/218, 216, 221, 222, 220/224, 8, 85 A, 85 B, 85 VS, 227, 220

[56] References Cited

U.S. PATENT DOCUMENTS

| | | | |
|---|---|---|---|
| 1,666,525 | 4/1928 | Bohnhardt | 220/85 A |
| 1,913,643 | 6/1933 | Smith | 220/221 X |
| 2,125,771 | 8/1938 | DeCastro | 220/218 X |
| 2,339,876 | 1/1944 | Phillips | 220/98 R X |
| 2,718,977 | 9/1955 | Wiggins | 220/277 |
| 3,436,196 | 4/1969 | Wiggins | 220/221 X |

*Primary Examiner*—Steven M. Pollard
*Attorney, Agent, or Firm*—Christie, Parker & Hale

[57] ABSTRACT

An open top tank for storing volatile liquids has a circular floating roof buoyantly supported on the surface of the stored liquid within a confining cylindrical shell of the tank. Adjustable sealing means extends between the roof and the top of the shell for sealing the gap between the roof and the surrounding shell. The adjustable sealing means includes a plurality of cylindrical annular sections of different diameters nested one inside another in telescoping relationship, the sections being coaxial with the shell and positioned above the floating roof. Limit means interconnects adjacent ones of the sections for limiting the vertical movement of each section relative to the next adjacent outer section and the outermost section relative to the surrounding shell. The limit means transfers the weight of any section in its lowest position through the limit means to the tank shell. The weight of each section in its highest position, and in its intermediate positions between lowest and highest, is supported by the floating roof. Flexible rolling diaphragms secured to and extending between each pair of adjacent sections and between the outer section and the shell provide an impervious barrier in the annular spaces between the nested sections and the shell, each diaphragm rolling over with relative vertical movement between the two associated sections. Variable volume gas holders on the floating roof provide a constant enclosed gas and vapor volume at constant liquid vapor pressures between the tank shell and the adjustable seal at all tank working liquid levels.

13 Claims, 7 Drawing Figures

ENCLOSED SEAL FOR OPEN TOP VOLATILE LIQUID STORAGE TANKS

FIELD OF THE INVENTION

This invention relates to floating roof liquid storage tanks, and more particularly, is concerned with a telescoping diaphragm for sealing the gap between the floating roof and the surrounding tank walls.

BACKGROUND OF THE INVENTION

The use of floating roof tanks for the storage of crude oil, gasoline and other volatile liquids is well known. To prevent the escape of vapors from the liquid stored in the tank to the atmosphere some type of sliding seal arrangement is provided to seal the annular gap between the periphery of the floating roof and the surrounding cylindrical shell of the tank. Because the walls of the tank are not perfectly smooth and because the cross-sectional shape of the tank departs from a true circle with changes in temperature, wind loads, and with shifting of the sub-surface material under the substantial weight of the stored liquid, such known sliding seals permit varying amounts of vapors to escape into the atmosphere at various roof elevations and at varying ambient conditions. Restrictions imposed by state and federal government agencies to restrict emissions into the atmosphere have imposed gap tolerances for the sliding seals which are difficult to meet and maintain. Even allowable emissions from sliding seals degredate ambient air quality to an extent in many areas such that closed roof tankage with expensive vapor recovery systems, or emission trade-offs with other industries, are necessary.

SUMMARY OF THE INVENTION

The present invention provides a totally enclosed seal for open top floating roof tanks, thereby eliminating the vapor and leakage problem of sliding seals. Thus the present invention eliminates the problem of maintenance and control of allowable tolerances to meet air quality standards by eliminating the need for the sliding seal itself. The totally enclosed seal is passive and so does not in itself consume energy as do the more conventional vapor recovery systems. A relatively small vapor balancing volume is required to compensate for changes in volume of the sealed region as the level of the liquid rises and falls in the tank.

These and other advantages of the present invention are achieved by providing a storage tank having a floating roof positioned within an outer cylindrical shell, the roof floating on the surface of the stored liquid. A totally enclosed seal for sealing the annular gap between the perimeter of the roof and surrounding shell has a plurality of cylindrical annular sections of different diameters nested one inside another in telescoping relationship, the sections being coaxial with and positioned inside the shell above the floating roof. The smallest diameter section is secured to the gas holders on the floating roof. The remaining sections are interconnected with each other and with the outer shell by means which permits only limited vertical movement of one section with respect to the other. The interconnecting means transfers the weight of any section in its lowest position through various means to the shell. As the roof rises, the weight of each of the sections in sequence, starting with the innermost section, is transferred to the roof and rises with the roof so as to telescope into the adjacent section. A flexible rolling diaphragm is secured to and extends between each pair of adjacent sections and between the outer section and the shell for providing an impervious barrier in the annular spaces between the nested sections, each diaphragm rolling over with relative vertical movement between the two associated sections in a manner which avoids crimping the diaphragm. Variable volume gas holder compartments are connected in fluid communication with each other and with the confined space above the liquid and between the inside of the shell and the telescoping sections for receiving gas from the confined space as the space is reduced in volume by a rising liquid level and resulting floating roof position in the tank.

DESCRIPTION OF THE DRAWINGS

For a more complete understanding of the invention reference should be made to the accompanying drawings, wherein.

DETAILED DESCRIPTION

Figure 1:
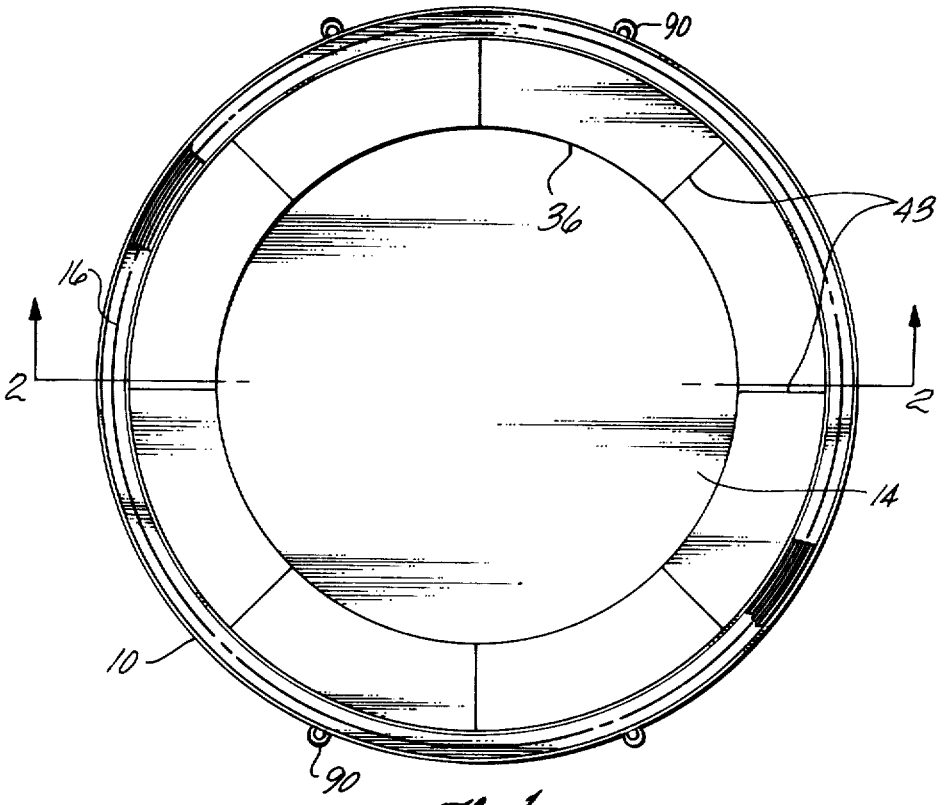
FIG. 1 is a plan view of the tank structure according to the present invention.

Referring to the embodiment shown in FIGS. 1–4 of the drawings in detail, there is shown a storage tank having a substantially cylindrical side wall or shell 10 and base 12 for storing a volatile liquid such as crude oil, gasoline or other volatile liquid. Such tanks typically run in the order of 60 to 300 or more feet in diameter and 40 to 60 or more feet in height, usually depending upon the allowable soil bearing loads. The liquid is pumped into the tank or removed from the tank from the bottom in conventional manner. The top of the tank shell 10 is open to the atmosphere. A disk-shaped floating roof 14 is positioned in the tank above the liquid. The conventional floating roof is constructed with air spaces which cause the roof to float on the surface of the liquid so that the roof moves up and down as the level of the liquid rises and falls within the tank. The conventional floating roof is also of a smaller diameter than the inner diameter of the tank shell 10 so as to leave an annular space between the perimeter of the roof and the inside of the shell, as indicated at 16, in order to accommodate the usual sliding seal and allow for any out-of-roundnesses. The floating roof accommodating this invention is basically conventional, but has no sliding seals and is maintained concentric with the shell and is restrained from rotation by suitable spring-loaded alignment rollers 20 which bear against the inner surface of the tank shell in a guided vertical track (not shown). A number of such rollers are positioned around the perimeter of the roof. Each roller is journaled on a supporting shaft which includes a radially extending portion 22 that slidably engages supporting guide brackets 24 on the bottom of the roof. A spring 26 urges the rollers outwardly against the inside wall of the tank shell 10. The tank roof 14 is generally of double wall construction, including an upper wall 30 and bottom wall 32 with an outer cylindrical edge plate 34. The top and bottom walls are spaced by bulkheads in conventional manner to provide a rigid, hollow construction with sufficient displacement to provide buoyant support of the roof on the surface of the liquid stored in the tank.

Figure 3:
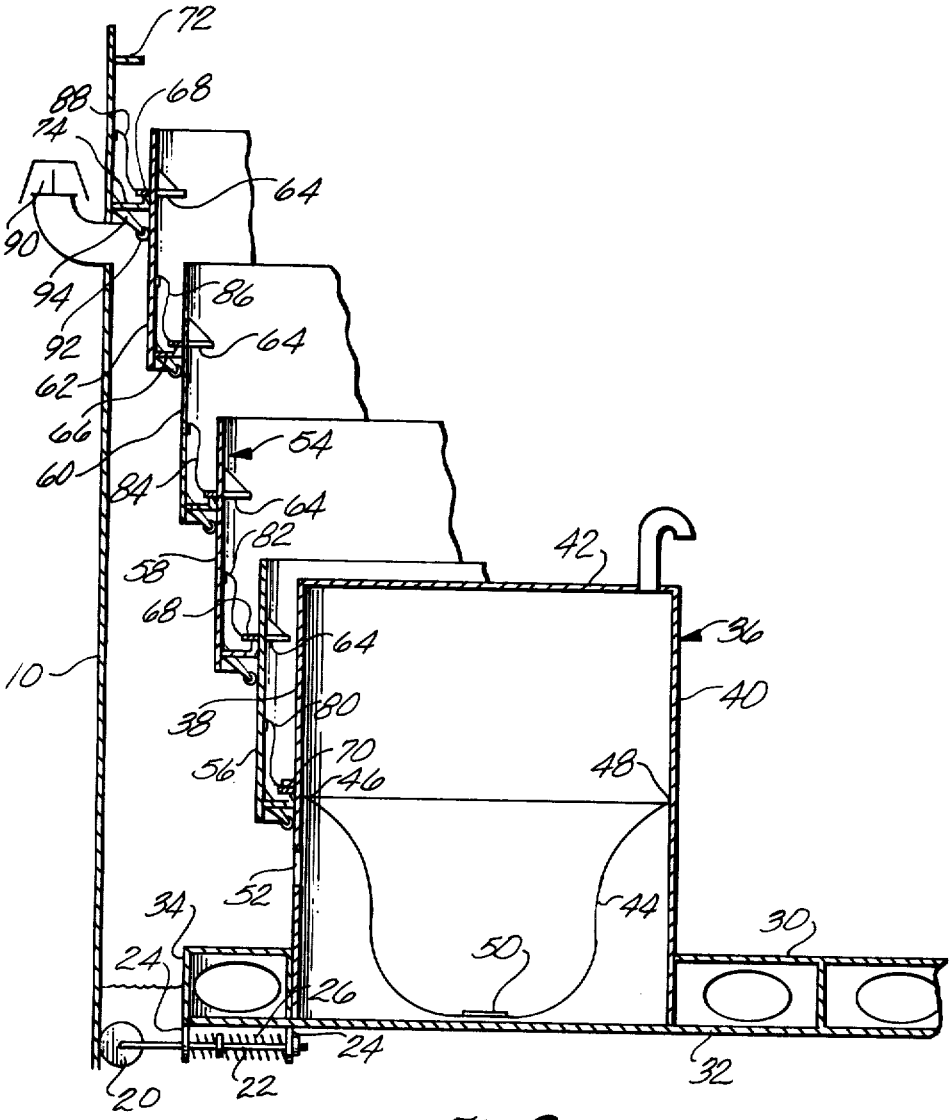
FIG. 3 is a detailed cross-sectional view of the fully enclosed seal with the tank roof in its lowest position.

To provide a gas-tight seal for the annular space between the roof and the wall of the tank, an annular gas holder, indicated generally at 36, is constructed on the roof and extends around the perimeter of the roof structure 14, as best seen in FIGS. 1 and 3. The gas holder 36 includes an outer cylindrical wall 38 secured to the bottom wall 32 in gas-tight relationship, an inner coaxial cylindrical wall 40 also secured to the bottom wall 32 of the floating roof in gas-tight relationship, and a top roof 42 which functions primarily to provide structural integrity to the gas holder. The gas holder is preferably divided into separate compartments by radial partitions 43 which attach to the roof 42 and extend below it far enough to support a flexible diaphragm 44 described as follows. The gas holder compartments each contain a flexible diaphragm 44 having one edge secured in a gas-tight manner to the inside of the outer wall 38 approximately half way between the bottom wall 32 and the top roof 42, as indicated at 46, best shown by FIGS. 3 and 4. An inner edge is similarly secured to the inside of the inner wall 40, as indicated at 48. The ends of the diaphragms are similarly secured to the roof partitions 43. The overall area of the flexible diaphragms is substantially greater than the area bounded by the outer wall 38 and inner wall 40 and adjacent partitions 43 of each gas holder compartment so that the diaphragms normally sag downwardly at the center of the compartments towards the bottom surface 32 of the gas holder chamber. An added weight 50 at the central part of each diaphragm 44 helps maintain the shape of the diaphragm as gas and vapors are transferred into and out of the gas holder chamber through a series of openings, one of which is indicated at 52, through the outer wall 38 communicating with the space below the diaphragm 44. Each gas holder compartment is in fluid communication with its adjacent gas holder compartments by the space below radial roof partitions 43. The manner in which gas is transferred into and out of the gas holder is described below.

The openings 52 communicate with an annular space between the outer tank shell 10 and the outer wall 38 of the gas holder above the surface of the liquid in the tank, as shown in FIG. 3. A fully enclosed telescoping seal assembly, indicated generally at 54, forms a gas-tight seal between the floating roof and the tank shell which provides a totally enclosed space above the surface of the liquid in which all vapors from the liquid stored in the tank are completely confined.

The telescoping seal assembly 54 includes a plurality of concentric cylindrical sections 56, 58, 60 and 62. While four such sections are shown by way of example in FIGS. 3 and 4 and three such sections in FIG. 5, it will be understood that the number of telescoping sections may be greater or less than these, depending upon the overall height of the tank, the extent of vertical working movement of the floating roof, and commercially available flexible diaphragm 44 widths.

Figure 4:
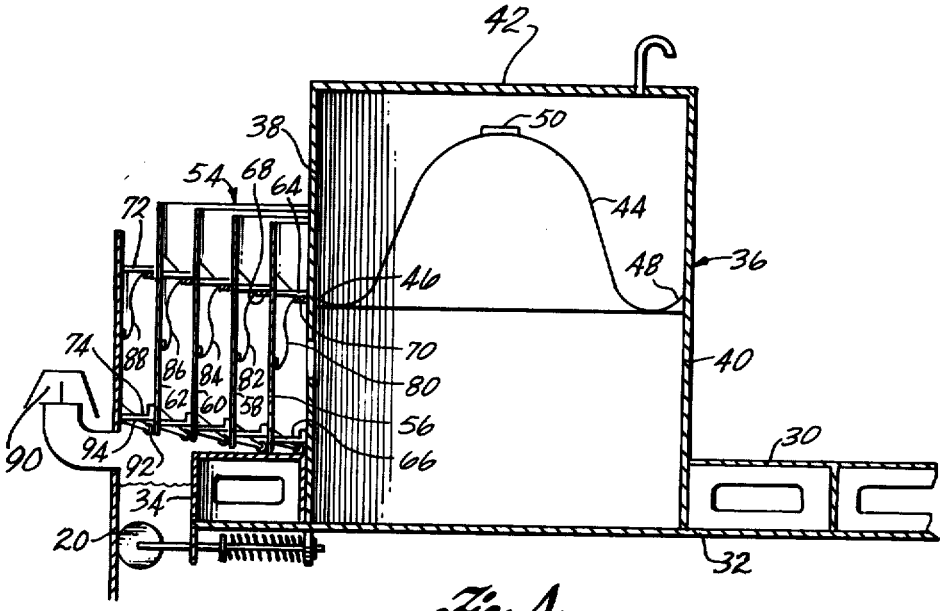
FIG. 4 is a similar detailed cross-sectional view of the fully enclosed seal with the roof in its uppermost position.
Figure 6:
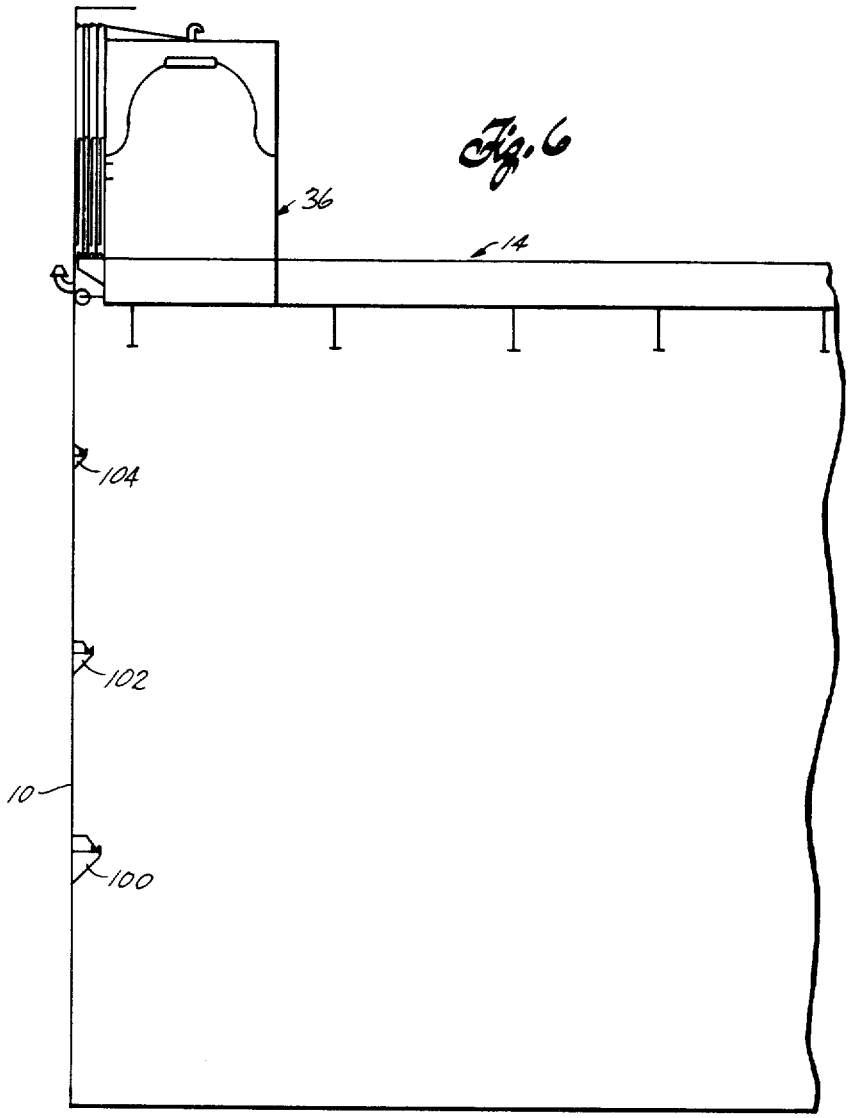
FIG. 6 is a partial sectional view of the same embodiment with the floating roof in the uppermost position.

Various stops for limiting the lower movement of each telescoping section are feasible. Such stop means include brackets 100, 102, and 104 supported on the tank shell 10, as shown in FIG. 6, flexible fixed-length steel cables attached either to the tank shell or to adjacent telescoping sections (not shown), or to flanged stops 74 and 66 on adjacent telescoping sections, as shown in FIGS. 3 and 4. The latter method, having both lower and upper stop limits on each telescoping section, has been chosen to illustrate the method by which telescoping sections operate. Each cylindrical section includes a plurality of upper stop members 64 and lower stop members 66 which project inwardly from the associated section at arcuately spaced positions. A limit flange 68 extends around the outside of each of the telescoping sections and is positioned to move between the limits fixed by the upper and lower stop members 64 and 66 of the next adjacent outer concentric section. A similar limit flange 70 extends from the outer surface of the outer wall 38 of the gas holder between the upper and lower stop member 64 and 66 associated with the innermost telescoping section 56. Similarly the outer tank shell 10 is provided with inwardly projecting upper and lower stop members 72 and 74, respectively.

With liquid removed from the tank to its lower working level, the floating roof and the telescoping seal sections 56, 58, 60 and 62 move downwardly to their lowest position in which the flanges 68 and 70 engage the lower stop members 66 and 74 of the adjacent concentric section. See FIG. 3. In this manner the weight of each of the intermediate telescoping sections in transferred to the tank shell 10 through the lower stop member 74 secured to the inside of the tank shell. Conventional fixed legs 11 under the foating roof support the roof on the tank floor 12 before lower stop member 66 on inner seal 56 engages limit 70. As the level of the liquid rises in the tank, the flange 70 projecting from the outer wall 38 of the gas holder 36 moves upwardly until it engages the upper stop member 64 of the innermost telescoping section 56. The weight of the section 56 is then transferred to the floating roof. As the floating roof continues to rise, it lifts the section 56 upwardly until the sealing flange 68 associated with the section 56 engages the upper stop member 64 of the next adjacent section 58. As the liquid level continues to lift the floating roof, each of the concentric sections in turn is lifted off the lower stop member of the next adjacent concentric section until the floating roof reaches its limit of upward travel, as shown in FIG. 4. The weight of each of the telescoping sections is then supported by limit flange 70. Overfilling the tank will cause the buoyant force of the roof to bear under upper shell stop 72 until the liquid level spills from an emergency relief valve 90.

To prevent escape of any vapors between the telescoping sections, flexible seals are provided in the annular spaces between the telescoping sections, as indicated at 80, 82, 84, 86 and 88, respectively. The generally annular shaped flexible membranes have an inner edge which is clamped or otherwise held in sealed relationship to the projecting flanges 68 or 70, and an outer edge which is clamped or otherwise secured in sealing relationship to the inner surface of the next adjacent concentric section. The outer edge of each membrane is secured at a point substantially half way between the upper and lower stop members 64 and 66. As the associated limit flange moves up and down between the limits of the stop members of the next adjacent section, the flexible membrane rolls within the annular space between the two confining cylindrical walls. The gas holder provides a constant positive gas pressure under the membrane equal to the weight of diaphragms 44 and weights 50, under all ambient conditions, so that the membrane is maintained in an upwardly convex position at all times. Each cylindrical section extends above its associated limit flange a sufficient distance vertically so as to be above the point at which the associated membrane is attached to the inner surface of the next adjacent concentric section in order to confine the circumferential changes in the membrane. Space between adjacent concentric sections is such that no more than a 2% change in circumferential length is required at the center portions of each membrane. Elasticity is limited in each membrane only to that extent and only in the circumferential direction. Thus the membrane at all times is confined between two concentric cylindrical surfaces, which surfaces cause the membrane to roll with smooth and consistently repeatable vertical movements between adjacent concentric surfaces without crimping or folding.

Figure 2:
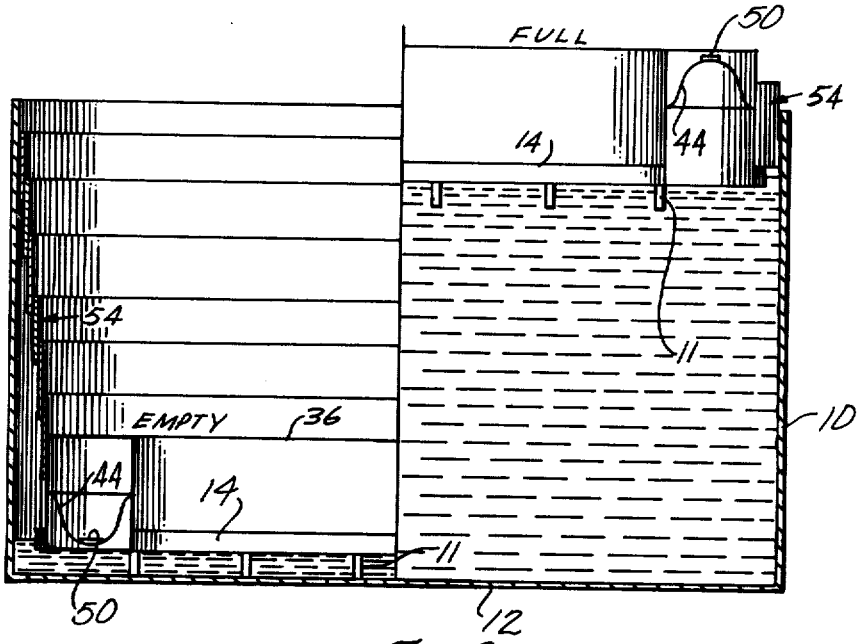
FIG. 2 is a sectional view taken substantially on the line 2—2 of FIG. 1 showing the tank roof in both its lowest position and its highest position in the tank.

It will be seen that as the floating roof rises in the tank, the enclosed volume above the surface of the liquid is reduced as the concentric sections successively move upwardly. Refer to FIG. 2. As that volume decreases, the constant gas and vapor volume is transferred at constant pressure to the gas holder, lifting the diaphragm 44 in the gas holder 36 upwardly to accommodate for the constant volume. The constant pressure of the vapors within this confined space above atmospheric pressure is very small, being only that equal to the weight of the diaphragm 44 and associated weights 50. The vapor volume will increase, however, with an increase in the true vapor pressure (volatility) of the liquid at its surface exposed to the confined sealed vapor volume. Such changes in liquid vapor pressure are accomodated by overages and underages in the design of gas holder volume and its charge of inert gas, as described below.

To reduce the hazard of combustion of the vapors, air is replaced by an inert gas such as nitrogen in the confined space above the surface of the liquid. The inert gas is injected into the gas holder when the tank is full. (See FIG. 2). The overpressure relief valve 90 communicates with the confined space to limit pressure buildup in the event of either excessive gas pressures or of accidental overfilling of the tank.

Various means may be provided for maintaining concentricity between the telescoping seal sections. For example, a plurality of guide rollers 92 axially supported on brackets 94 projecting below the lower stop members 66 and 74 may be provided. The rollers 92 engage the outer surface of the next adjacent cylindrical section at a plurality of arcuately spaced positions around the circumference of each section to limit the radial spacing between the telescoping sections.

Figure 5:
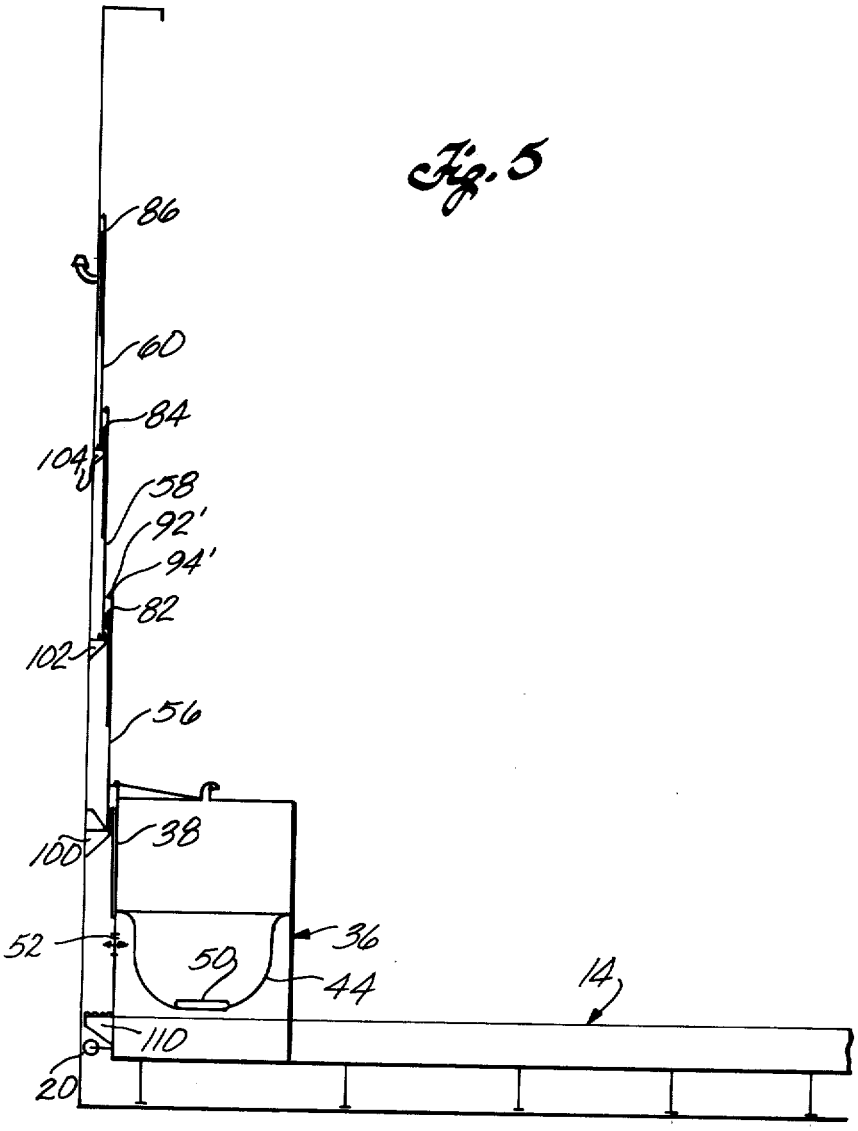
FIG. 5 is a partial sectional view of an alternative embodiment of the present invention showing the floating roof in the lowest position.
Figure 7:
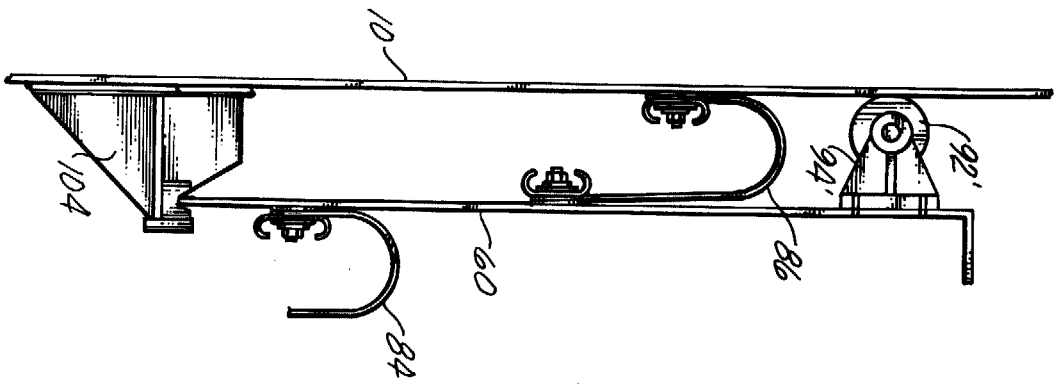
FIG. 7 is a detailed cross-sectional view of one pair of cylindrical sections and associated sealing membrane.

Referring to FIGS. 5–7 there is disclosed an alternative preferred embodiment in which the telescoping cylindrical sections are individually supported in their lower positions directly from the outer shell 10 of the tank. Thus the innermost section 56 rests on a plurality of arcuately spaced supporting brackets, one of which is shown at 100, spaced around the inner perimeter of the tank and which project radially inwardly below the section 56. Similarly, the next outer telescoping section 58 is supported at its lower edge by a plurality of brackets 102 secured to the inside of the shell, and the uppermost section 60 is supported in its lowest position on a plurality of brackets 104 secured to the inside of the shell. The brackets 104 are shorter than the brackets 102, which in turn are shorter than the bracket 100, so each section can move upwardly inside the brackets supporting the larger diameter sections.

In the embodiment shown in FIGS. 5, 6, and 7, only three telescoping sections are shown positioned between the inside of the shell and the cylindrical outer wall of the gas holder 36 by way of example. It will be understood that the number may be more or less. Guide rollers 92' supported on brackets 94' are positioned at the upper edge of each of the sections and are in rolling engagement with the inner wall of the next adjacent outer section. This positions the rollers outside the entrapped gas region and in the open area of the tank, making the rollers and associated bearings less susceptible to corrosion and more accessible for servicing. Membranes 80, 82, 84 and 86 extend between the adjacent surface of the telescoping sections of the seal in the manner described above in connection with FIGS. 1–4. The manner in which the membranes are attached to the walls to form gas-tight barriers in the annular spaces between the telescoping sections is shown in more detail in FIG. 7.

As the floating roof rises with the level of liquid in the tank, the cylindrical sections of the seal are lifted successively off their supporting brackets by a plurality of lifter arms 110 extending radially outwardly from the floating roof 14 in the annular space between the outer perimeter of the floating roof and the inside of the tank shell. While only one lifter arm is shown, it will be understood that they are positioned at arcuately spaced positions around the perimeter of the floating roof and are angularly offset from the positions of the brackets 100, 102, and 104. Thus, as shown in FIG. 6, as the roof moves to its uppermost position, the lifter arms 110 successively pass the supporting brackets 100, 102, and 104, moving into engagement successively with the bottom edge of the cylindrical sections 56, 58, and 60 of the seal. Thus each section is carried upwardly successively with the floating roof as the floating roof moves to its uppermost position, as shown in FIG. 6. The arrangement shown in FIGS. 5–7 has the advantage that the weight of the sections are their lowermost position is transferred directly to the shell of the tank, rather than all being transferred back to the support for the outermost section.

From the above description it will be seen that a completely enclosed floating roof tank is provided which eliminates any sliding seals. Close tolerances between the tank shell and sliding roof seals are obviated as are the sliding seals themselves. The total enclosed vapor control seal is passive and requires a minimum of surveillance to maintain a gas-tight system. The telescoping arrangement and constant positive internal pressure controls the flexible movements and minimizes the sizes of the individual membranes. The flexible seals do not come in direct contact with the liquid even if the tank is overfilled and flooding. The pressure head of the liquid is transferred directly to the outer shell of the tank at all levels. As the weight of the telescoping seal transfers between the shell of the tank and the floating roof, there is no increase on gas pressure in the confined region above the liquid. Any change in liquid vapor pressure, or rise in the level of the liquid due to increased weight imposed by the seals on the floating roof, is effectively compensated by a change in volume of the gas holder.

Most importantly, the enclosed seal arrangement can be retrofitted to floating roof tank installations currently in use to replace the sliding seals.

What is claimed is:

1. A tank for storing volatile liquids comprising a base, an upstanding cylindrical shell secured to the base for holding the liquid, a circular floating roof of smaller diameter than the interior of the shell positioned within the shell and adapted to be buoyantly supported on the surface of the liquid, and movable sealing means extending between the roof and the shell for sealing the gap between the roof and the surrounding shell from the ambient atmosphere, the sealing means including a plurality of concentric cylindrical annular sections of different diameters nested one inside another in telescoping relationship, the sections being coaxial with and positioned inside said shell above the floating roof, means securing the smallest diameter section to the top of the floating roof in gas-tight relationship, limit means interconnecting the sections and the shell for limiting the vertical movement of each section, the limit means transferring the weight of any section in its lowest position to the shell, and its weight in any intermediary position to the floating roof, flexible rolling membranes secured to and extending between each pair of adjacent sections and between the outer section and the shell for providing an impervious barrier in the annular spaces between the nested sections and the shell, and variable volume gas holder means in fluid communication with the confined space above the liquid and between the inside of the shell and the outside of said sections, the gas holder receiving gas from said confined space as the space is reduced in volume by a rising liquid level in the tank, and supplying gas to said confined space as the space is increased in volume by a lowering liquid level in the tank.

2. The apparatus of claim 1 wherein the gas holder means is mounted on and moves with the floating roof.

3. The apparatus of claim 2 wherein the gas holder means comprises means forming an annular chamber positioned inside and coaxial with the innermost section of the seal, and flexible diaphragm means forming an enclosure of said chamber which permits the volume of the chamber to vary inversely with the changing volume of the annular space between the tank and the adjustable seal.

4. The apparatus of claim 3 further including overflow relief means in fluid communication with the tank at a level below the level at which the diaphragm is attached to the shell.

5. Apparatus of claim 1 wherein said limit means includes upper and lower stop members secured to one side of each section and a support member projecting from the adjacent section between the upper and lower stop members for engaging the one or the other of the stop members with relative movement between the two sections.

6. Apparatus of claim 5 further comprising variable volume gas holder means secured to the inside of the innermost section and in fluid communication with the outside of the innermost section below the associated membrane.

7. Apparatus of claim 1 wherein said limit means includes a plurality of support brackets projecting inwardly from the inside of the shell at different vertical positions, the brackets at each particular vertical position engaging one of the sections in its lowermost position, and lift means projecting outwardly from the floating roof, the lift means engaging each of the telescoping sections in sequence as the floating roof rises in the tank, the lift means as it engages each section lifting the sections off the associated support brackets.

8. Apparatus of claim 7 wherein the gas holder means includes a gas-tight chamber, one wall of which is formed by said innermost section, the chamber having a flexible cover, the innermost section opening into the chamber.

9. A fully enclosed seal for a liquid storage tank of a type having a cylindrical shell and movable roof that floats on the surface of the liquid and moves up and down in the shell as the liquid level changes, the seal comprising: a plurality of concentric cylindrical sections adapted to be positioned inside the shell above the level of the liquid on which the roof is floating the sections being coaxial with the shell, an impervious membrane extending between and attached to each pair of adjacent sections, each membrane being flexible to permit relative vertical movement of the two sections to which it is attached while preventing escape of gas through the space between the sections, the sections and membranes forming a gas-tight volume above the surface of the liquid that varies in volume as the floating roof moves up and down with changes in the liquid level, and a variable volume gas holder means in fluid communication with said gas-tight volume, the gas holder means changing in volume with changes in said liquid level and with changes in true vapor pressure of the liquid in the storage tank and with changes in temperature of the gas in said gas-tight volume caused by ambient temperature changes.

10. Apparatus of claim 9 further including limit means interconnecting the sections for limiting vertical movement of each section relative to the next adjacent section, said limit means including lower limit means supporting the sections from the storage tank shell when in their lowermost positions, and upper limit means transferring the weight of each section from the storage tank to the floating roof starting with the innermost section as the innermost section is raised.

11. Apparatus of claim 10 wherein the upper edge of each section when in its lower limit position extends above the level at which the associated membrane is attached to the next outer section, whereby each flexible membrane is confined in the annular space between the two associated sections throughout the limits of relative movement between two adjacent sections.

12. Apparatus of claim 10 wherein the limit means includes upper and lower radially projecting stop members secured to each section at vertically spaced positions and a radially projecting support member secured to each section, relative vertical movement between two adjacent sections moving the support member between and into engagement with the upper and lower stop members of the next adjacent section.

13. Apparatus of claim 9 further including limit means interconnecting the sections for limiting vertical movement of each section relative to the next adjacent section, said limit means including lower limit means supporting the inner sections from the outermost section when in their lowermost positions, and upper limit means transferring the weight of each section from the adjacent outer section to the adjacent inner section starting with the innermost section as the innermost section is raised.

* * * * *